US009457252B2

(12) United States Patent
Schwarz

(10) Patent No.: US 9,457,252 B2
(45) Date of Patent: Oct. 4, 2016

(54) BASEBALL PRACTICE DEVICE

(71) Applicant: Stephen F Schwarz, St. Petersburg, FL (US)

(72) Inventor: Stephen F Schwarz, St. Petersburg, FL (US)

( * ) Notice: Subject to any disclaimer, the term of this patent is extended or adjusted under 35 U.S.C. 154(b) by 72 days.

(21) Appl. No.: 14/245,227

(22) Filed: Apr. 4, 2014

(65) Prior Publication Data

US 2015/0283442 A1 Oct. 8, 2015

Related U.S. Application Data

(60) Provisional application No. 61/809,924, filed on Apr. 9, 2013.

(51) Int. Cl.

| | |
|---|---|
| ***A63B 69/00*** | (2006.01) |
| ***A63B 71/00*** | (2006.01) |
| *A63B 69/36* | (2006.01) |

(52) U.S. Cl.

CPC ..... *A63B 69/0002* (2013.01); *A63B 69/0075* (2013.01); *A63B 69/3644* (2013.01); *A63B 2069/0008* (2013.01); *A63B 2210/50* (2013.01)

(58) Field of Classification Search

CPC A63B 63/00; A63B 69/0075; A63B 63/083; A63B 69/004; A63B 69/0091; A63B 69/205; A63B 69/24; A63B 69/36; A63B 69/38; A63B 69/3644

USPC ..... 473/417, 422, 451, 454, 423; D21/715–721, 780

See application file for complete search history.

(56) References Cited

U.S. PATENT DOCUMENTS

| | | | | | |
|---|---|---|---|---|---|
| 2,272,765 | A | * | 2/1942 | Beeson et al. | 473/417 |
| 2,616,692 | A | * | 11/1952 | Bird | 473/417 |
| 4,174,085 | A | * | 11/1979 | Ferreira | B65B 67/1205 248/97 |
| 4,194,735 | A | * | 3/1980 | Wilson | A63B 69/0002 473/452 |
| 4,273,167 | A | * | 6/1981 | Stillwell | B65B 67/12 248/97 |
| 4,364,563 | A | * | 12/1982 | Stafford | 473/417 |
| 4,684,087 | A | * | 8/1987 | Spickard | B65B 67/12 248/97 |
| 4,853,990 | A | * | 8/1989 | Elder | A47C 20/041 5/634 |
| 4,886,267 | A | * | 12/1989 | Licciardi et al. | 473/417 |
| 5,029,852 | A | * | 7/1991 | Gilfillan | 473/417 |
| 5,106,085 | A | * | 4/1992 | Lewy | 473/417 |
| 5,297,302 | A | * | 3/1994 | Anderson | A45F 3/24 5/127 |
| 5,322,276 | A | * | 6/1994 | Hardison, Jr. | 473/417 |
| 5,763,832 | A | * | 6/1998 | Anselm | H02G 3/0625 174/135 |

(Continued)

*Primary Examiner* — Mitra Aryanpour
(74) *Attorney, Agent, or Firm* — Thomas Frost

(57) ABSTRACT

The present invention is a baseball practice device having a base frame with a pair of tubular members connected perpendicular to each other by mounting to an elbow tube fitting. A tee tube fitting is slideably positioned on one of the tube members. An aluminum pole is mounted to the tee tube fitting and a tee member with a flexible support member is inserted into the pole. At the distal end of the support member, baseball mounting means are attached. A baseball hitter places a ball on the mounting means to practice a swing. The support member allows the hitter to adjust the ball position to a different vertical or horizontal elevation as needed.

7 Claims, 8 Drawing Sheets

(56) References Cited

U.S. PATENT DOCUMENTS 5,772,536 A * 6/1998 Wang ..... 473/417
5,868,364 A * 2/1999 MacMillan ..... B65B 67/12 248/97
5,934,488 A * 8/1999 Grimshaw ..... A63C 11/028 211/113
5,944,613 A * 8/1999 Dubois ..... A63B 69/3667 473/218
D430,243 S * 8/2000 Alberti et al. ..... D21/715
6,164,607 A * 12/2000 Hawkes ..... A63B 55/50 248/97
6,413,175 B1 * 7/2002 Mooney, Jr. ..... 473/417
6,616,554 B2 * 9/2003 Liao ..... 473/417
6,666,781 B1 * 12/2003 Illis ..... 473/453
7,066,432 B2 * 6/2006 Wood ..... B65B 67/1205 248/99
7,222,825 B2 * 5/2007 Gilbert ..... B65F 1/1415 248/97
7,404,686 B2 * 7/2008 Volum ..... F16L 37/098 285/370
8,029,389 B2 * 10/2011 Chiu ..... 473/417
8,162,780 B2 * 4/2012 Wang ..... 473/417
D665,862 S * 8/2012 Nunez ..... D21/715
8,678,829 B2 * 3/2014 Manfre ..... A63B 17/00 434/258
8,932,155 B2 * 1/2015 Moore ..... 473/423
2005/0288120 A1 * 12/2005 Brescia ..... A63B 69/0002 473/452
2006/0035729 A1 * 2/2006 Wang ..... 473/417
2010/0056306 A1 * 3/2010 Chen ..... 473/417
2011/0183781 A1 * 7/2011 Chiu ..... 473/417
2011/0183782 A1 * 7/2011 Wang ..... 473/417

* cited by examiner

BASEBALL PRACTICE DEVICE

BACKGROUND OF INVENTION

The present invention relates to a portable training device used to practice proper baseball swing plane.

The device addresses shortcomings in currently available batting tees. The current device is portable, durable and easily disassembled. A standard tee is of a size and of a weight which makes it difficult to transport. At the other extreme are travel tees which are inadequately constructed and will not hold up on a regular basis.

SUMMARY OF THE INVENTION

The general purpose of the present invention, which will be described subsequently in greater detail, is to provide new and improved training device.

The present device has a base frame with a pair of tubular members connected perpendicular to each other by mounting to an elbow tube fitting. A tee tube fitting is slideably positioned on one of the tube members. An aluminum pole is mounted to the tee tube fitting and a flexible gooseneck is inserted into the pole. At the distal end of the gooseneck, baseball mounting means are attached. A baseball hitter places a ball on the baseball holder to practice a swing. The gooseneck allows the hitter to adjust the ball position to a different vertical or horizontal elevation as needed.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
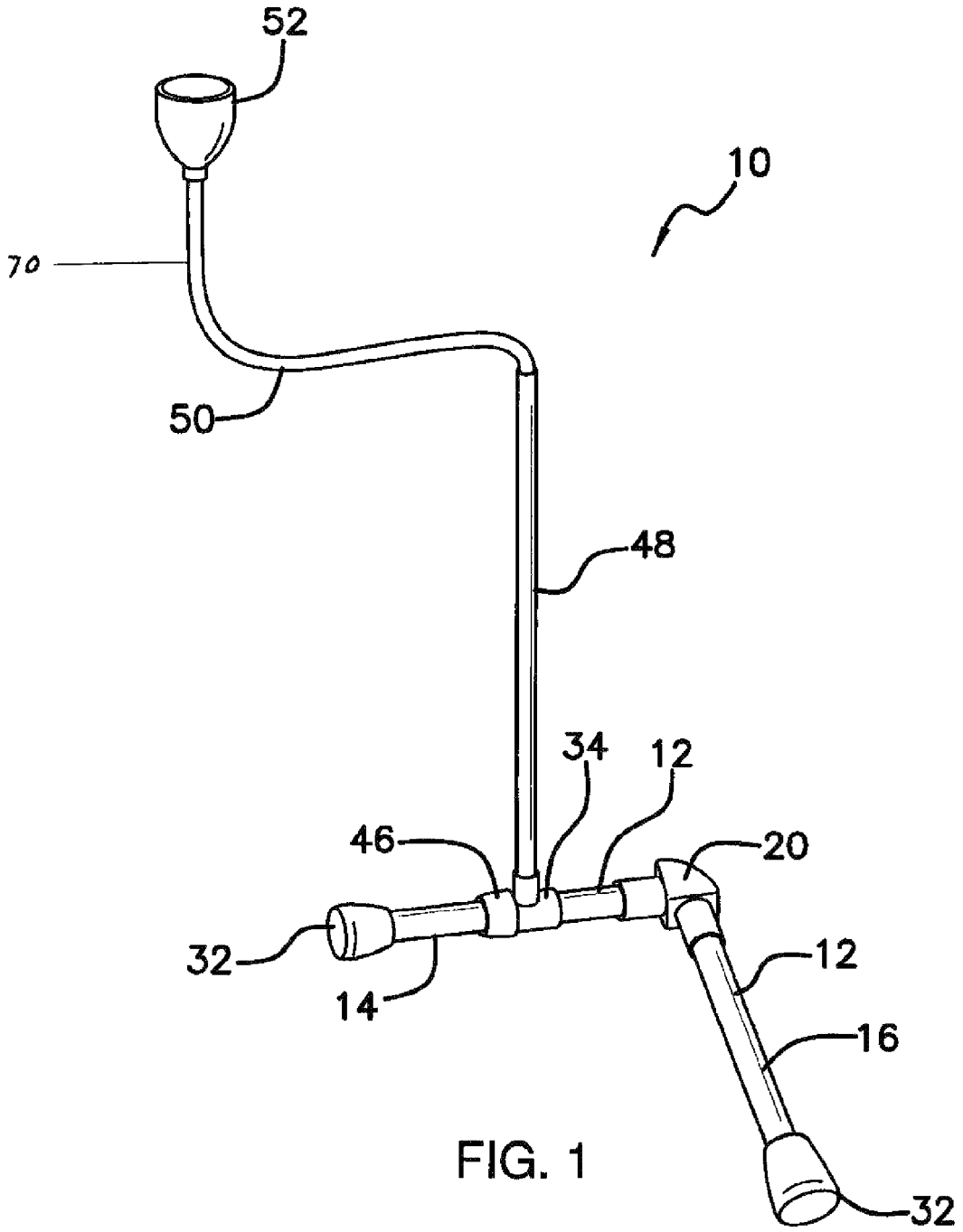
FIG. 1 is a front perspective view of the present invention.

Referring to FIGS. 1 through 7, generally, an embodiment of the present invention, denoted generally by reference numeral 10, will now be described in greater detail.

As illustrated in FIG. 1, the device 10 includes a base frame 12 for support having a first tubular base member 14 and a second tubular base member 16. The members 14, 16 have a pair of opposed snaps 18 (as more particularly illustrated in FIG. 3) integrally formed at one end. The members are preferably formed of aluminum.

Figure 4A:
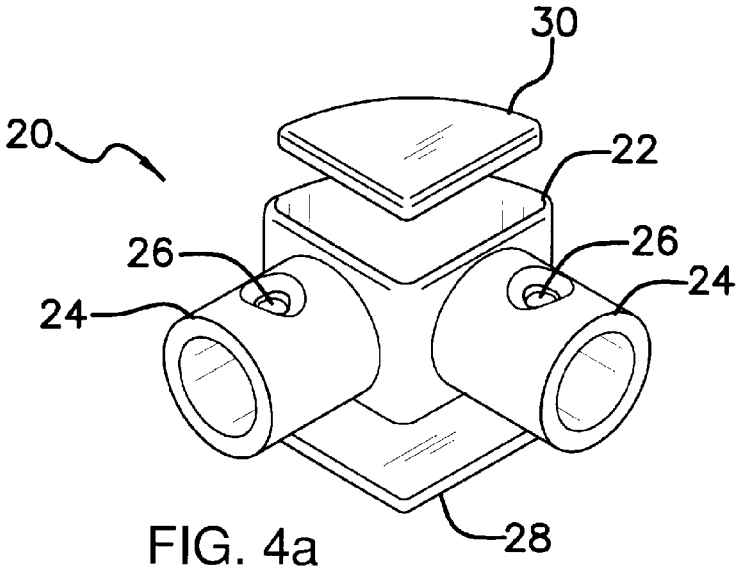
FIG. 4*a* is a frontal view of a corner piece.
Figure 4B:
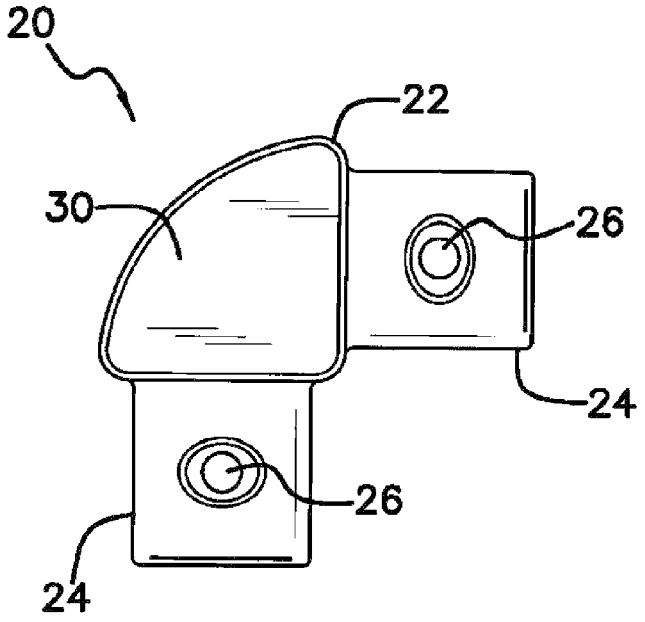
FIG. 4*b* is a top plan view of the corner piece.
Figure 4C:
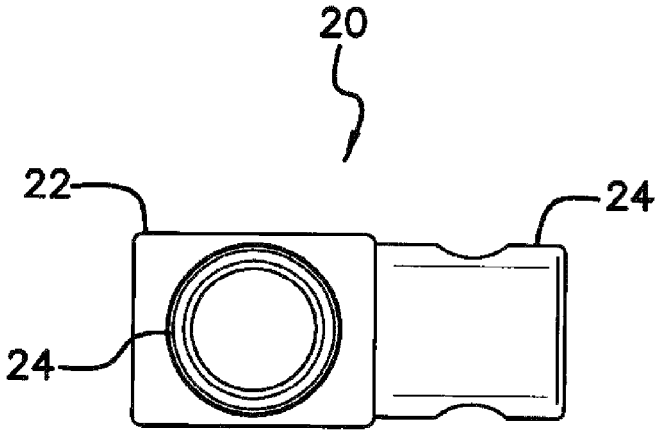
FIG. 4*c* is a side view of the corner piece.

As further illustrated in FIG. 1, and as more particularly illustrated in FIGS. 4*a*-4*c*, an elbow corner piece 20, preferably formed of non-skid rubber material, has a generally triangular shaped shell 22 with side walls, and having a cavity defined therethrough and an opening defined at a first end. Tubular conduits 24 with apertures 26 formed on upper and lower surfaces of the tubular conduits 22 extend outwardly perpendicular to each other from the shell 22. The shell 22 is affixed to a base platform 28. An insert 30 fits inside the cavity surface. The corner piece 20 is positioned between the tubular members 14, 16. The apertures 26 of the tubular conduits 24 are of a predetermined size to engage with the snaps 18 of the tubular members 14, 16. The tubular members 14, 16 will snap or lock into the corner piece 20. The tubular members 14, 16 are thus oriented perpendicular to each other. It should be recognized that the means to connect the tubular members to the corner piece are not limited to snaps, but could include other means such as inwardly/outwardly threaded surfaces. The platform 28 and the insert 30 are preferably formed of a non-skid material, such as rubber, with either side mountable on the ground surface.

Figure 7A:
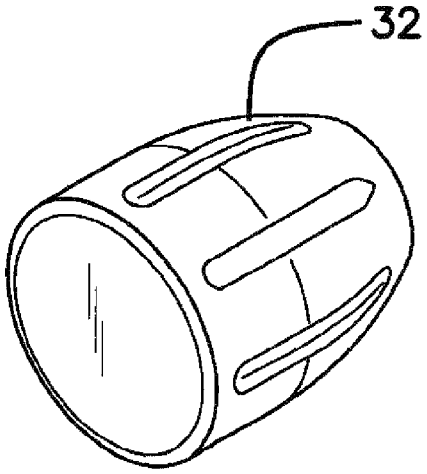
FIG. 7*a* is a top view of an end cap attachable to a tubular member and FIG. 7*b* is a front view of the end cap.
Figure 7B:
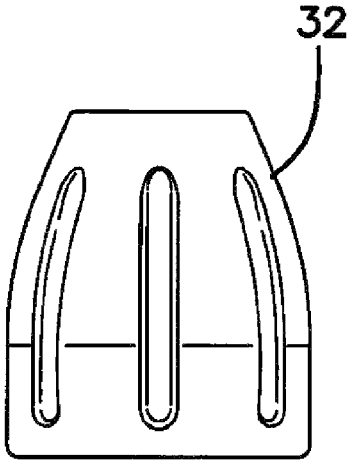

As further illustrated in FIG. 1, and as more particularly illustrated in FIGS. 7*a*-7*b*, end caps 32, preferably formed of rubber, connect to second ends of the tubular members 14, 16. It can be seen that the caps 32 and the corner piece 20 lift the tubular members 14, 16 from the ground surface, and act as a leveler. The end caps 32 preferably have a plurality of indentations formed on an outer surface to provide a non-skid surface.

Figure 5A:
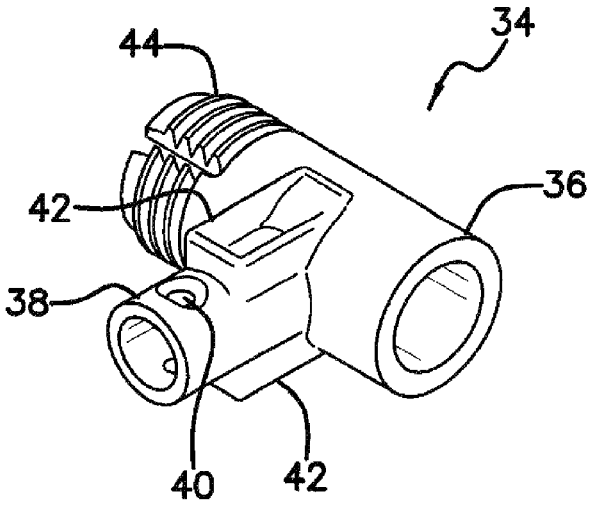
FIG. 5*a* is a front perspective view of a tee tube fitting.
Figure 5B:
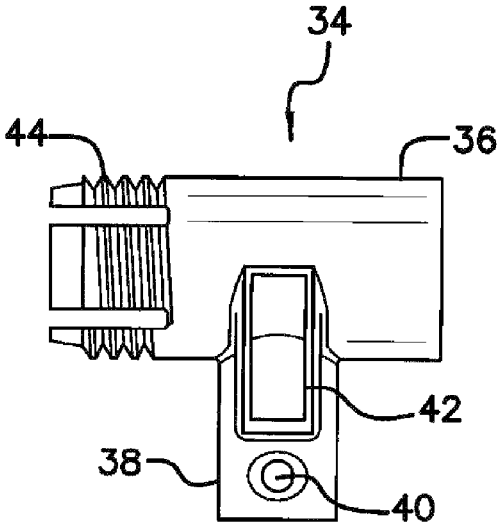
FIG. 5*b* is a top plan view of the tee tube fitting and FIG. 5*c* is a side view of the tee tube fitting.
Figure 5C:
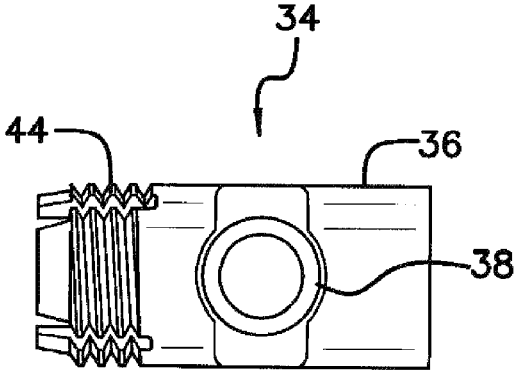
Figure 6A:
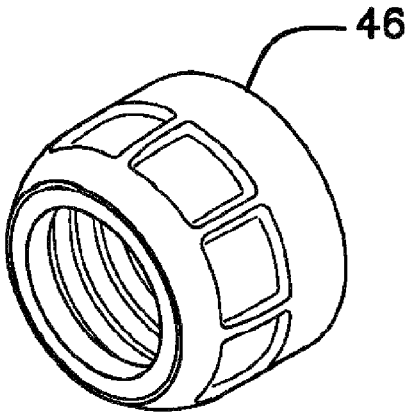
FIG. 6*a* is a top plan view of a collar attachable to the tee tube fitting and FIG. 6*b* is a side cross-sectional view of the collar.
Figure 6B:
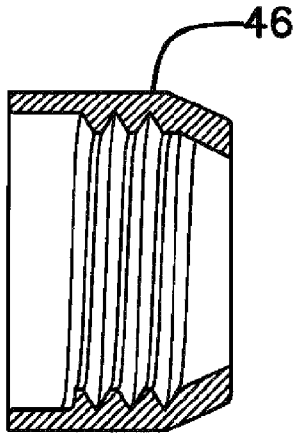

As further illustrated in FIG. 1, a tee tube fitting 34, as particularly illustrated in FIGS. 5*a*-5*c*, has a cylindrical sleeve 36 with a bore therethrough to mount on one of the tubular members 14, 16. A tubular elbow 38 having an opening defined at a first end extends outwardly and perpendicular to the sleeve 36. The elbow 38 has a pair of apertures 40 formed juxtaposed the opening. A pair of rectangular protrusions 42, having an end wall and side walls, is integrally formed on opposed sides of the tubular elbow 34. The protrusions 42 engage the ground surface and maintain the stability of the fitting 34 and balance the frame 12. The sleeve 36 has an outwardly threaded extension 44 at one end. A collar 46, as more particularly illustrated in FIGS. 6*a*-6*b*, is inwardly threaded to mate with the extension 44 of the sleeve 36. The collar 46 can be disengaged and the tee tube fitting 34 repositioned along the tubular member 14, from parallel to the ground to vertical. The tee tube fitting 34 is capable of pivoting 180 degrees axially during use of the device.

Figure 2:
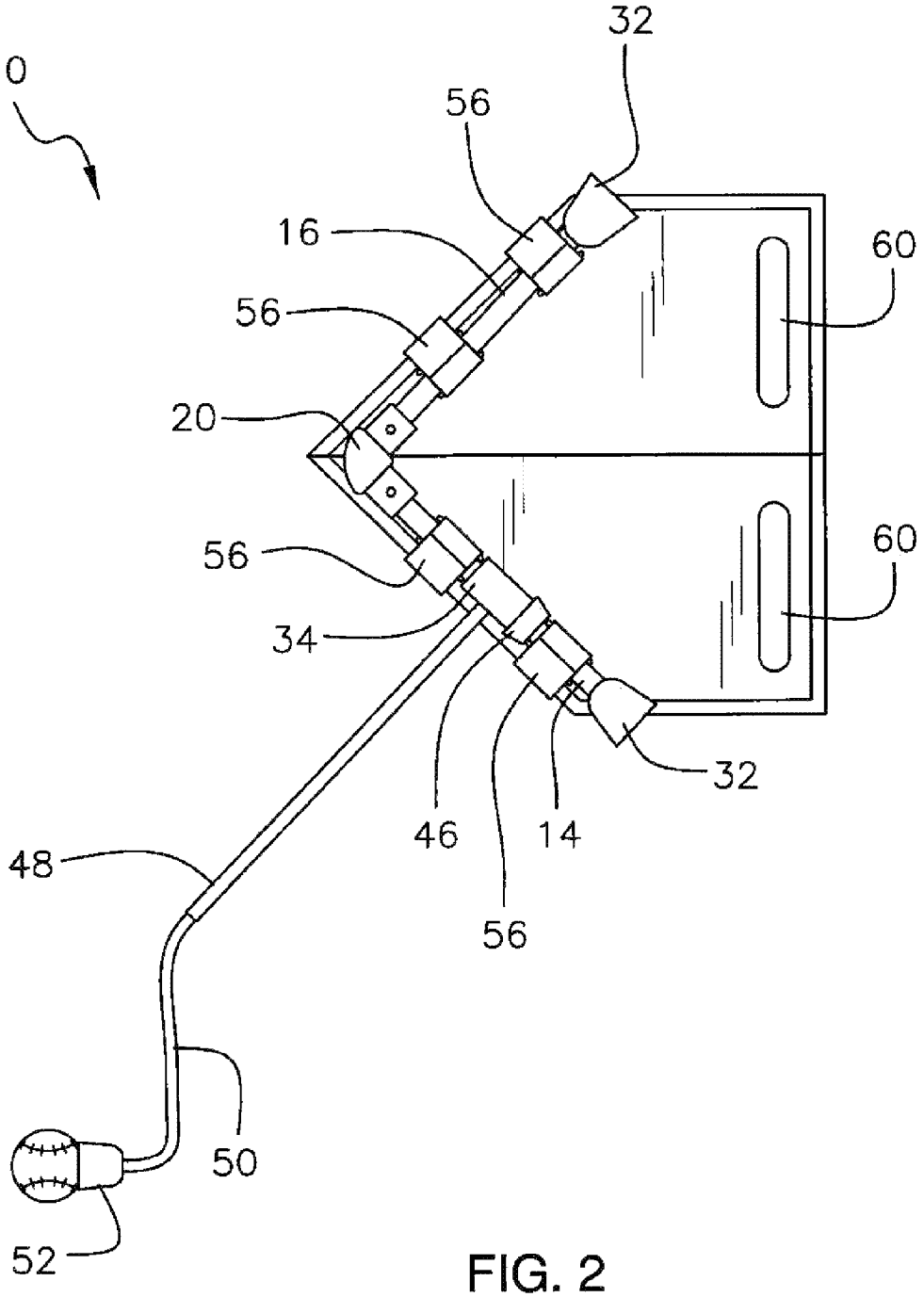
FIG. 2 is a view of the present invention attached to a baseball plate.
Figure 3:
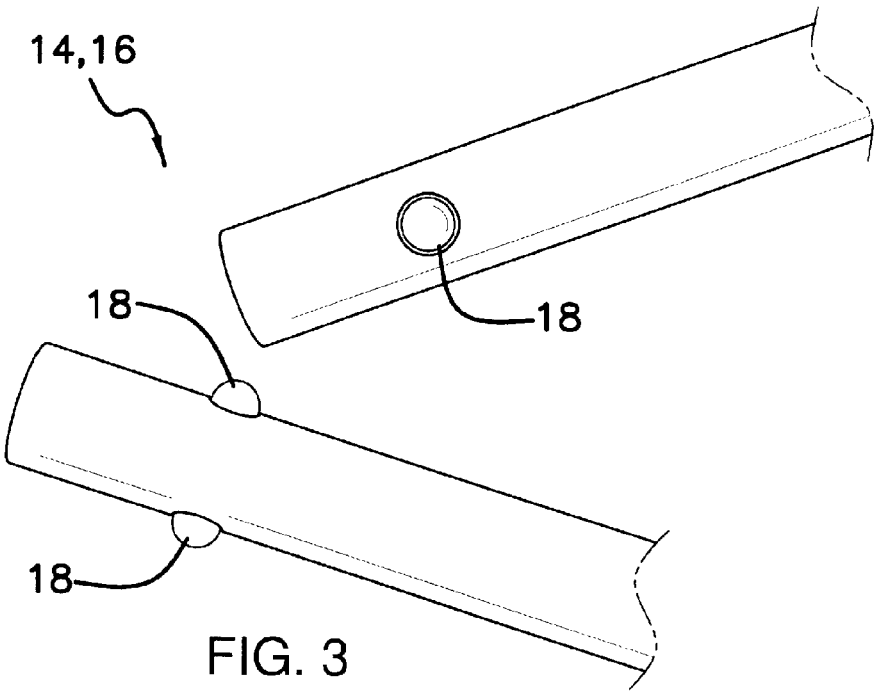
FIG. 3 is a fragmentary view of end of tubular members illustrating snaps.
Figure 9:
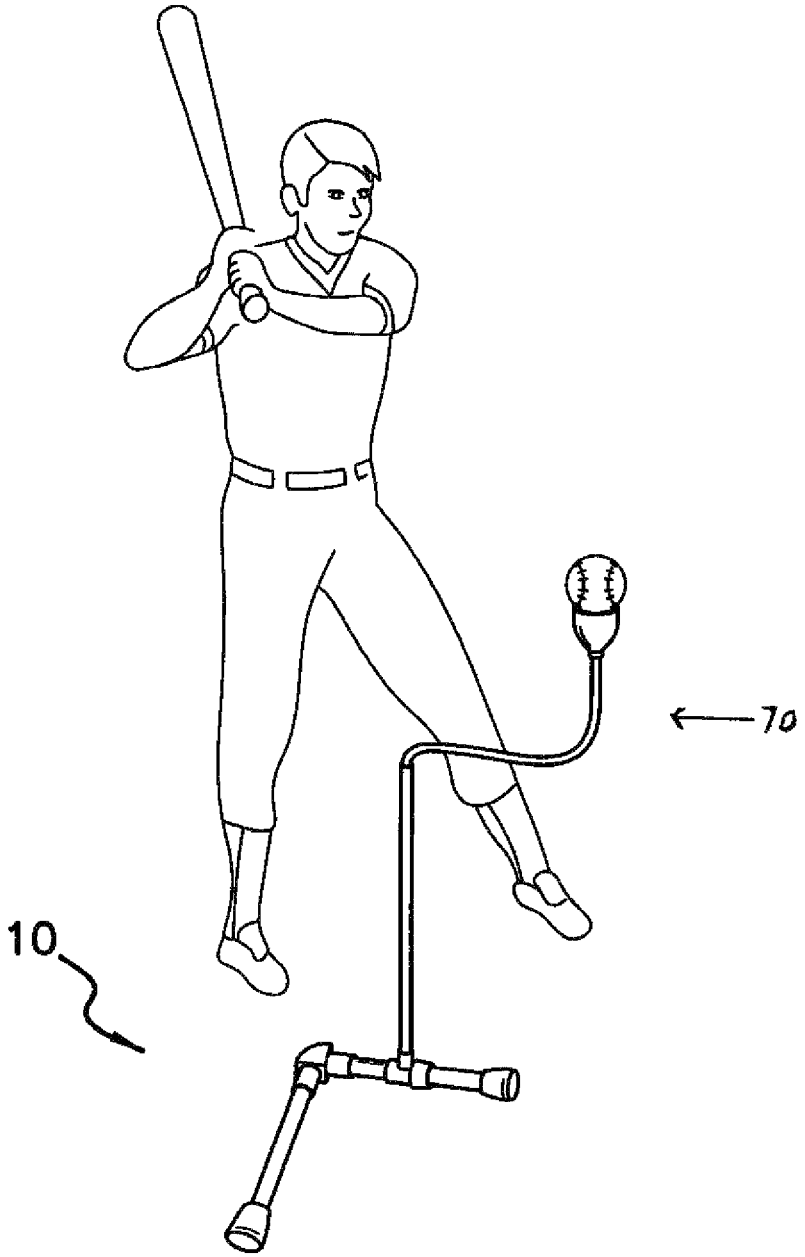
FIG. 9 illustrates the use of the invention by a baseball hitter.

A pole 48, as illustrated in FIGS. 1, 2 and 9, preferably made of aluminum and approximately 22 inches in length, has a first end and a second end, and has a bore formed therethrough with snaps integrally formed on an outer surface at the first end. The pole 48 is of a predetermined size and engages with the tubular elbow 38 at the first end. A gooseneck 50, composed of flexible material with a vinyl coating, is inserted into a second end of the pole 48. At one end of the gooseneck 50, a baseball holder 52, having a concave area to mount a baseball or softball, preferably made of high impact rubber, is affixed. A baseball design may be embossed on the upper outer surface of the baseball holder 52.

The device 10 is designed for use on a planer surface, and non-skid coverings are on all corners and other surfaces of the device 10 touching the ground. It should also be recognized that the device 10 can be positioned on a planer surface in reverse image of FIG. 1 to accommodate a different use or user.

The device 10 permits the user to hit a baseball from the baseball holder. Use of the device for a particular individual is accomplished by repositioning the tee tube fitting 34 and the gooseneck 50. The tee tube fitting 34 can be rotatably adjusted in relation to the hitter by disengaging the collar 46 and repositioning along the frame 12. Repositioning of the gooseneck 50 allows the baseball to be placed closed to, or further away from, the user without moving the device.

The frame 12 provides stability by keeping the pole 48 and gooseneck 50 from tipping over when the end caps 32 are oriented away from the hitter. The pole 48 and gooseneck 50 do not need to be connected to the frame 12 for use. It should be recognized that the pole 48 can be optionally mounted on other objects or placed into the ground.

Figure 8A:
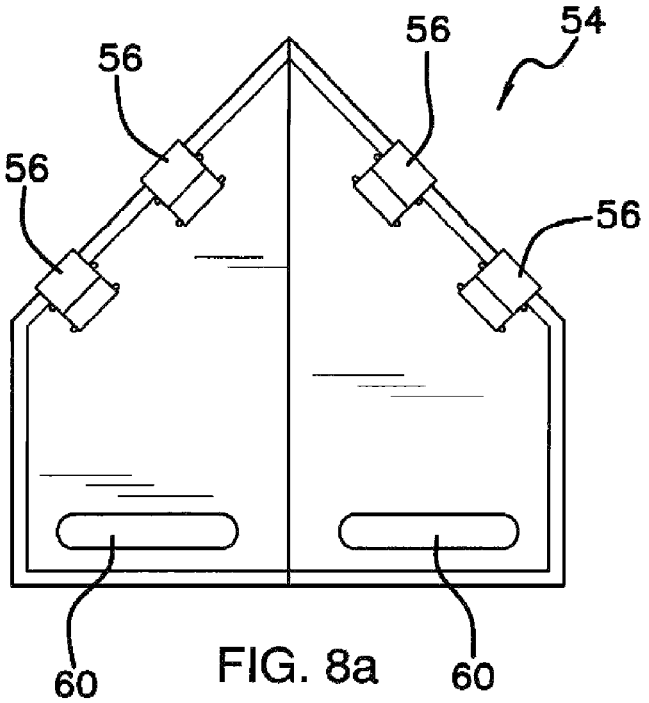
FIG. 8*a* is a top view of a plate with fastening means and FIG. 8*b* is the plate in folded position.
Figure 8B:
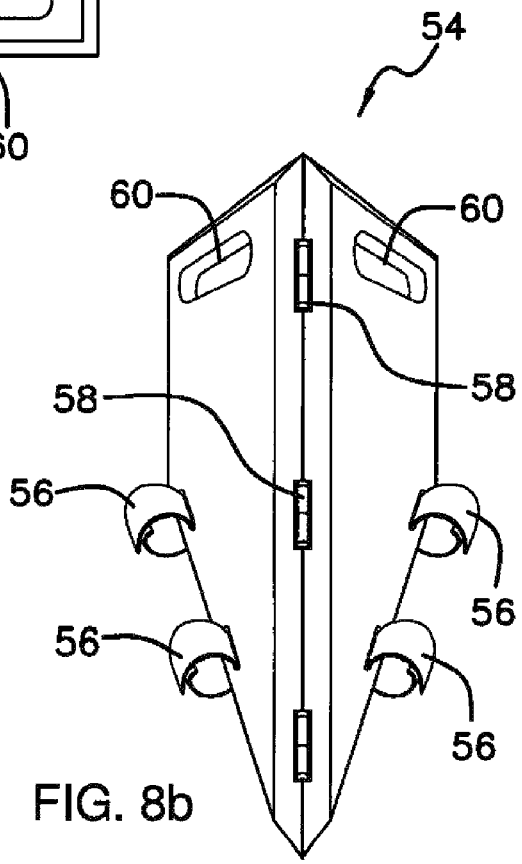

As illustrated in FIG. 2, optionally the frame 12 can be mounted on a home plate 54. As illustrated in FIGS. 8*a*-8*b*, the plate 54 has a peripheral edge, and an upper surface and a lower surface. There are a plurality of hook and loop strips 56 affixed to the peripheral edge. The plate 54 has hinge means 58 that allow the plate 54 to be folded, and a pair of passages 60 defining handles formed therethrough. During use, the plate 54 provides further stability as a platform for the base frame 12. The strips 56 fasten around the base members 14, 16. It can be readily seen that the plate is portable.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A portable baseball practice device, comprising in combination:

a frame having a first tubular member and a second tubular member, the first tubular member and the second tubular member each having a first end and a second end, and a corner piece having a generally triangular shaped shell with a pair of tubular conduits extending outwardly perpendicular to each other with the first ends of the first tubular member and the second tubular member each inserted into the conduits;

end caps connected to the second ends of the first tubular member and the second tubular member;

a tee tube fitting having a cylindrical sleeve and a tubular elbow with a defined opening extending outwardly and perpendicular to the cylindrical sleeve, wherein the cylindrical sleeve includes an outwardly threaded extension formed at one end, and whereby the tee tube fitting is slideably mountable on either the first tubular member or the second tubular member;

an inwardly threaded collar mateable with the outwardly threaded extension, whereby when the inwardly threaded collar is disengaged from the outwardly threaded extension the tee tube fitting may be repositioned along either the first tubular member or the second tubular member;

a pole having a first lower end and a second upper end, and having a bore formed therethrough, connected to the tubular elbow of the tee tube fitting at the first lower end of the pole;

a gooseneck having a first lower end and a second upper end, and composed of flexible material, inserted at the first lower end of the gooseneck into the second end of the pole; and a baseball holder affixed to the second upper end of the gooseneck.

2. The device as set forth in claim 1, further comprising a pair of rectangular protrusions, each protrusion having an end wall and side walls integrally formed on opposed sides of the tubular elbow of the tee tube fitting.

3. The device as set forth in claim 2, whereby the tubular elbow has a pair of apertures formed therein juxtaposed the opening.

4. The device as set forth in claim 3, whereby the pole has snaps integrally formed on an outer surface at the first lower end engageable with the apertures formed in the tubular elbow.

5. The device as set forth in claim 1, whereby the first tubular member and the second tubular member each have a pair of opposed snaps formed at the first ends of the first tubular member and the second tubular member, and the tubular conduits of the corner piece each have a pair of apertures formed therein, and whereby the snaps of the first tubular member and the second tubular member each are securely engaged in the apertures.

6. The device as set forth in claim 4, whereby the shell of the corner piece is affixed to a base platform.

7. A portable baseball practice device, comprising in combination:

a frame having a first tubular member and a second tubular member, the first tubular member and the second tubular member each having a first end and a second end, and a corner piece having a generally triangular shaped shell with a pair of tubular conduits extending outwardly perpendicular to each other with the first ends of the first tubular member and the second tubular member each inserted into the conduits;

end caps connected to the second ends of the first tubular member and the second tubular member;

a tee tube fitting having a cylindrical sleeve and a tubular elbow with a defined opening extending outwardly and perpendicular to the cylindrical sleeve, and having an outwardly threaded extension formed at one end, and whereby the tee tube fitting is slideably mountable on either the first tubular member or the second tubular member;

an inwardly threaded collar mateable with the outwardly threaded extension, whereby when the collar is disengaged from the extension the tee tube fitting may be repositioned along either the first tubular member or the second tubular member;

a pole having a first lower end and a second upper end, and having a bore formed therethrough, connected to the tubular elbow of the tee tube fitting at the first lower end of the pole; and a gooseneck having a first lower end and a second upper end, and composed of flexible material, inserted at the first lower end of the gooseneck into the second upper end of the pole;

a baseball holder affixed to the second upper end of the gooseneck;

a baseball home plate main body having a standard pentagonal shape used in baseball, and having a first section and a second section, the first section and the second section each having a peripheral edge, an upper surface and a lower surface, and having a plurality of hinges affixed to the lower surfaces of the first section and the second section that permit the baseball home plate main body to be folded; and a plurality of hook and loop strips affixed to the baseball home plate main body that connect to the first tubular member and the second tubular member of the frame to securely mount the first tubular member and the second tubular member of the frame on the upper surface of the baseball home plate main body.

* * * * *